US008849158B2

(12) United States Patent
Kamano

(10) Patent No.: US 8,849,158 B2
(45) Date of Patent: Sep. 30, 2014

(54) TRANSFER DEVICE OF IMAGE FORMING APPARATUS AND RELATED IMAGE FORMING APPARATUS

(75) Inventor: Tadao Kamano, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 309 days.

(21) Appl. No.: 13/247,935

(22) Filed: Sep. 28, 2011

(65) Prior Publication Data

US 2012/0099896 A1 Apr. 26, 2012

Related U.S. Application Data

(60) Provisional application No. 61/405,500, filed on Oct. 21, 2010, provisional application No. 61/405,508, filed on Oct. 21, 2010, provisional application No. 61/405,484, filed on Oct. 21, 2010, provisional application No. 61/405,477, filed on Oct. 21, 2010.

(51) Int. Cl.

| | |
|---|---|
| ***G03G 15/08*** | (2006.01) |
| ***G03G 15/16*** | (2006.01) |
| ***G03G 21/16*** | (2006.01) |

(52) U.S. Cl.

CPC ..... *G03G 15/161* (2013.01); *G03G 2221/1654* (2013.01); *G03G 2221/1642* (2013.01); *G03G 21/1633* (2013.01); *G03G 21/1638* (2013.01)

USPC ..... 399/121; 399/124; 399/313

(58) Field of Classification Search

CPC ..... G03G 21/1638; G03G 21/168; G03G 2221/1642; G03G 2221/1654; G03G 21/1633; G03G 15/161

USPC ..... 399/121, 124, 313

See application file for complete search history.

(56) References Cited

U.S. PATENT DOCUMENTS

| | | | | |
|---|---|---|---|---|
| 5,787,326 | A * | 7/1998 | Ogawa et al. | 399/124 |
| 2007/0110486 | A1* | 5/2007 | Okaji | |
| 2009/0022514 | A1* | 1/2009 | Fujiwara et al. | 399/121 |
| 2009/0154957 | A1* | 6/2009 | Furuya | 399/121 |
| 2010/0003051 | A1* | 1/2010 | Sekina et al. | 399/121 |
| 2010/0247173 | A1* | 9/2010 | Okabe | |
| 2010/0278557 | A1* | 11/2010 | Somemiya et al. | 399/124 |
| 2011/0236059 | A1* | 9/2011 | Saito et al. | |

FOREIGN PATENT DOCUMENTS

| | | |
|---|---|---|
| JP | 2004-020574 | 1/2001 |
| JP | 2009-251135 | 10/2009 |

* cited by examiner

*Primary Examiner* — David Gray
*Assistant Examiner* — Laura Roth
(74) *Attorney, Agent, or Firm* — Patterson & Sheridan LLP

(57) ABSTRACT

The transfer device transfers a toner image to a recording medium. The recording medium passes through a nip portion formed by a belt roller which is disposed on a main body of an apparatus and a transfer roller which is disposed on an opening and closing cover. The opening and closing cover opens and closes an opening of a main body of the apparatus. The main body includes a positioning member which positions the transfer roller which moves according to a closing operation of the opening and closing cover, to a predetermined distance with respect to the belt roller. The main body also includes an engaging member which engages with the transfer roller and pushes the transfer roller toward a positioning position of the positioning member, by being urged by a pressurizing spring.

11 Claims, 7 Drawing Sheets

TRANSFER DEVICE OF IMAGE FORMING APPARATUS AND RELATED IMAGE FORMING APPARATUS

CROSS-REFERENCE TO RELATED APPLICATION

This application is based upon and claims the benefit of priority from: US provisional application 61/405,500, filed on Oct. 21, 2010; 61/405,508, filed on Oct. 21, 2010; 61/405,484, filed on Oct. 21, 2010; 61/405,477, filed on Oct. 21, 2010, the entire contents of all of which are incorporated herein by reference.

FIELD

Embodiments described herein relate to a pressurizing mechanism of a transfer device which is provided in an image forming apparatus such as a copy machine or a printer.

BACKGROUND

An image forming apparatus such as an electrophotography-type copy machine or a printer includes a transfer device which transfers a toner image which is carried by an image carrier, using a transfer member such as a transfer roller which is disposed at a transfer position, to a member for transferral.

There is a type of a transfer device which allows sheets to pass through between a photoconductive drum as an image carrier and a transfer roller which comes into contact with the photoconductive drum in a pressurizing manner, and transfers a toner image carried on the photoconductive drum to the sheets. In addition, there is a type of a transfer device which primarily transfers the toner image which is carried in the photoconductive drum onto an endless transfer belt, and then transfers the toner image on the transfer belt to the sheet which is allowed to pass through a nip portion between the external transfer roller and the transfer belt, with respect to a pair of transfer rollers which are disposed to face each other in the inside and outside of the transfer belt.

Meanwhile, in the image forming apparatus, an opening and closing cover, which is opened and closed with respect to a main body of the image forming apparatus, is provided at a portion of a sheet conveying path, in order to remove jammed paper in the main body of the image forming apparatus. A configuration in which a transfer member of the transfer device is attached as one such opening and closing cover is proposed.

When the opening and closing cover with the transfer member attached is opened with respect to the image forming apparatus main body, the pinched state of the sheet is released, since the transfer member is separated from the transfer position. In addition, when the opening and closing cover with the transfer member attached is opened, it becomes possible for someone to insert their hands into the sheet conveying path including the periphery of the transfer position, and it is possible to easily treat the jammed paper on which an unfixed toner image is carried.

The transfer member which is attached to the opening and closing cover is held to the opening and closing cover through a pressurizing mechanism which is configured by a spring, or the like. In a state where the opening and closing cover is closed, the transfer member applies a sufficient nip load to the sheet which is passed through for transferring, in order to perform a stable transfer to various sheets.

When the opening and closing cover with the transfer member attached is closed, a reaction force of the nip load is applied to the opening and closing cover with the transfer member attached. For this reason, it is necessary for the opening and closing cover with the transfer member attached to have a high strength and high rigidity and, as a result, the opening and closing cover becomes large and heavy with a complicated structure. In addition, a strong force which resists the pressurizing force of the pressurizing mechanism is necessary when closing the opening and closing cover with the transfer member attached.

Further, the nip load between a transfer member which is attached to the opening and closing cover, for example, a transfer roller on the cover side and a transfer roller (or a photoconductive drum) which is disposed on the main body side of the image forming apparatus which forms a nip portion with the transfer roller on the cover side, is determined, for example, on the basis of the distance between axes of both transfer rollers. The transfer roller on the opening and closing cover side comes into close contact with a positioning member, which is fixed to the main body of the image forming apparatus, and is positioned. For this reason, a predetermined nip load may not be obtained depending on the precision of parts or the precision of attachment, or variation may occur in the nip load in the front and rear of the transfer roller in the axial direction.

DETAILED DESCRIPTION

In general, according to one embodiment of the invention, there is provided a transfer device which transfers a toner image to a member for transferral which passes through a nip portion which is formed by a first transfer member disposed on a main body of an apparatus, and a second transfer member which is disposed on an opening and closing cover which opens and closes an opening portion of the main body of the apparatus.

There is provided a positioning member which positions the second transfer member which moves according to a closing operation of the opening and closing cover, to a predetermined distance with respect to the first transfer member.

There is provided an engaging member which engages with the second transfer member, and pushes the second transfer member toward a position which is positioned by the positioning member, by being urged by an elastic member.

First Embodiment

First, a first embodiment will be described with reference to drawings.

Figure 1:
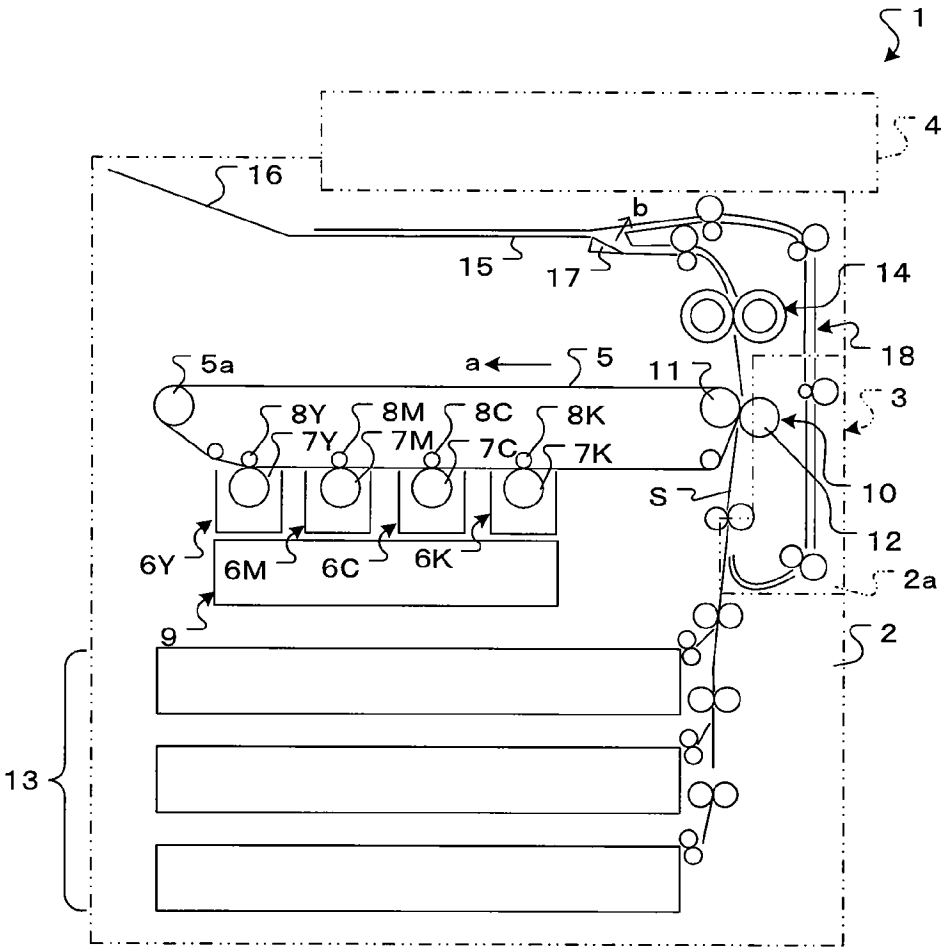
FIG. 1 is a schematic diagram which illustrates a first embodiment of an image forming apparatus.

FIG. 1 is a front view which illustrates a schematic configuration of an electrophotography-type image forming apparatus.

The image forming apparatus 1 shown in FIG. 1 is a Multi-Function Peripheral (MFP) which has an opening and closing cover 3 on one side of a main body 2 of the image forming apparatus, and an image reading unit 4 on the upper side of the main body 2 of the image forming apparatus. An endless transfer belt (a primary transfer member) 5, which moves in a direction of an arrow a, is disposed in the main body 2 of the image forming apparatus. The transfer belt 5 is turned over a roller such as a driving roller 5*a*, a transfer roller 11 on one side of a transfer device 10, or the like. A process cartridge 6Y of yellow, a process cartridge 6M of magenta, a process cartridge 6C of cyan, and a process cartridge 6K of black are disposed in the periphery of the transfer belt 5. Photoconductive drums 7Y, 7M, 7C, and 7K of each process cartridge come into contact with the transfer belt 5 in a pressurizing manner, through the primary transfer rollers 8Y, 8M, 8C, and 8K at a primary transfer position.

A latent image is formed in each of the photoconductive drums 7Y, 7M, 7C, and 7K, using exposure light of images from a laser unit 9, and each latent image is developed using toner and using the developing unit of each of process cartridges 6Y, 6M, 6C, and 6K. The toner image which is formed on each of photoconductive drums 7Y, 7M, 7C, and 7K is primarily transferred to the transfer belt 5, using the primary transfer rollers 8Y, 8M, 8C, and 8K, and moves toward a secondary transfer position on which a transfer device 10 is disposed.

Regarding the transfer device 10, one transfer roller 11 and the other transfer roller 12 are disposed in the inside of the transfer roller 5, to face each other, with the transfer belt 5 interposed therebetween. The other transfer roller 12 is pressurized toward the one transfer roller 11. One transfer roller 11 is attached to a main body 2 side of an image forming apparatus, and the other transfer roller 12 is attached to an opening and closing cover 3 side. A sheet S is conveyed to a nip portion between the other transfer roller 12 and the transfer roller 5, from a sheet feeding cassette 13, and the toner image on the transfer belt 5 is transferred to the sheet S. The sheet S on which an unfixed toner image is secondarily transferred, is conveyed toward a fixing unit 14, and the unfixed toner image is fixed to the sheet S by being pressurized and heated. The sheet S on which the image is fixed, is conveyed to a discharge tray 16, through a sheet conveying path 15.

Here, when a double-sided printing is performed, a flapper 17 moves in a direction of an arrow b, and the sheet S on which one-sided printing is ended, is guided to a reverse path 18. A portion of the reverse path 18 is attached to the opening and closing cover 3. Accordingly, when paper jamming occurs in the transfer device 10, if the opening and closing cover 3 which clogs an opening portion 2*a* of the main body 2 of the image forming apparatus, is opened, the other transfer roller 12 is separated from a secondary transfer position. Accordingly, it is possible for someone to insert their hands into the secondary transfer position, and it is possible to easily treat the jamming of the sheet S which is carrying the unfixed toner image.

Figure 2:
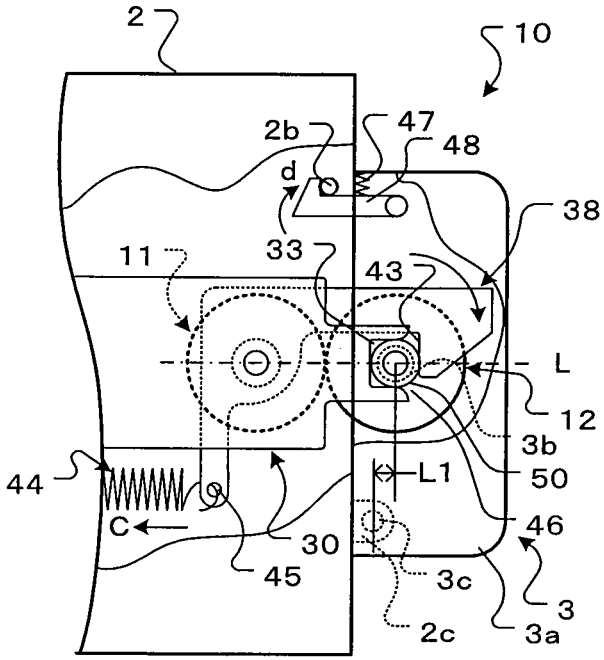
FIG. 2 is a partially cut front view of a transfer device shown in FIG. 1.
Figure 3:
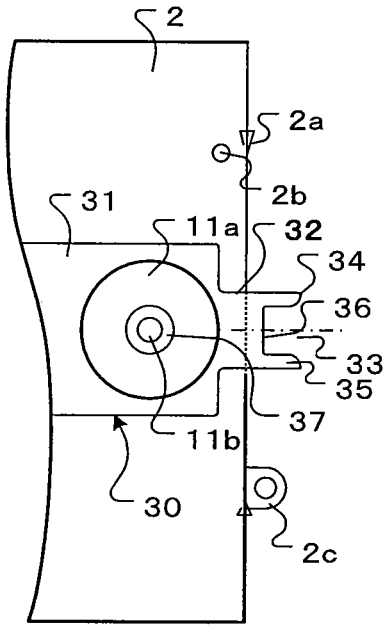
FIG. 3 is a diagram which illustrates a positioning member of FIG. 2.
Figure 4:
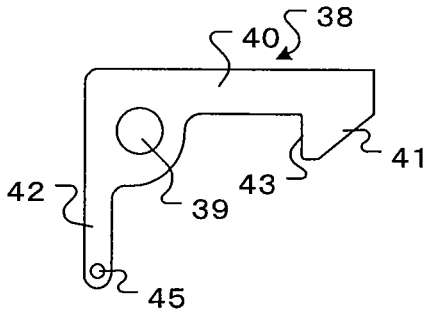
FIG. 4 is a diagram which illustrates a roller hook of FIG. 2.
Figure 5:
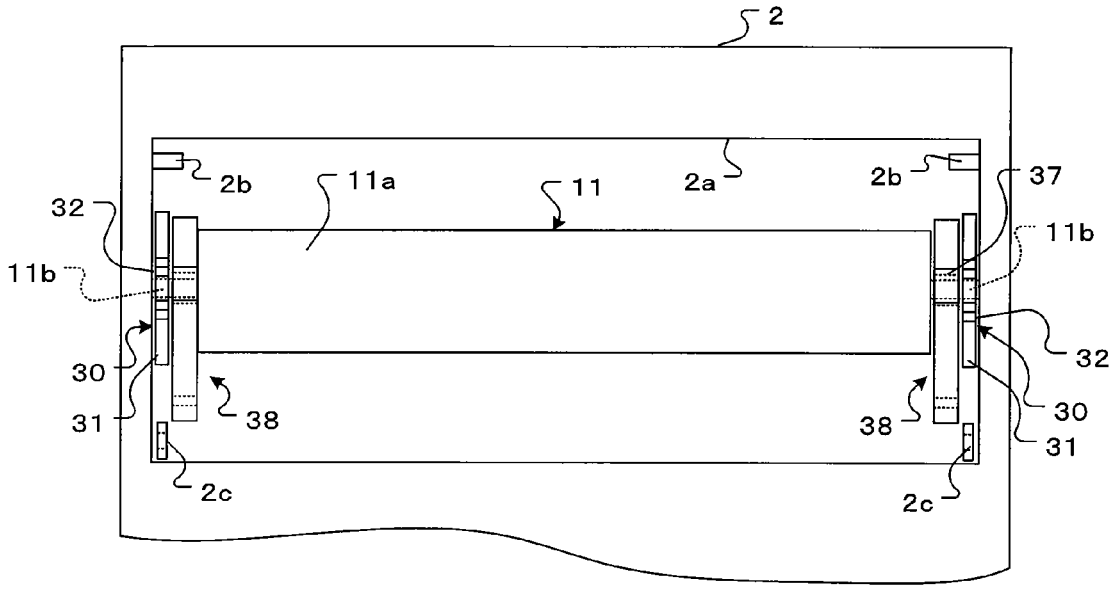
FIG. 5 is a diagram which illustrates an image forming apparatus main body in a state where an opening and closing cover is opened in FIG. 2.
Figure 6:
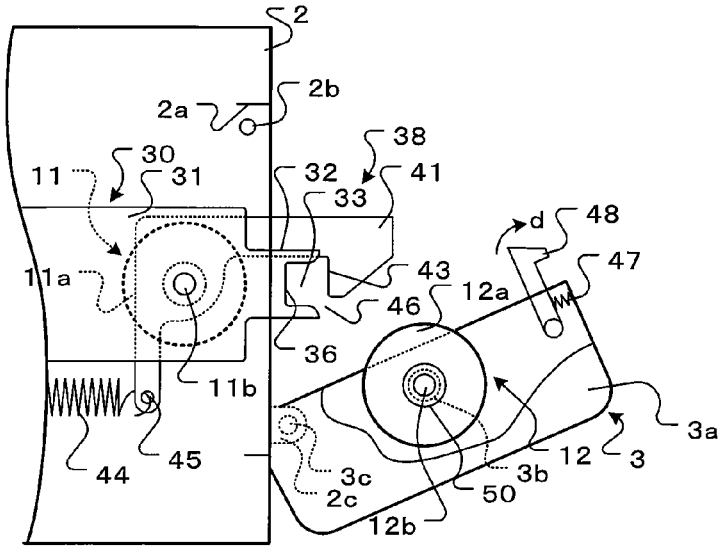
FIG. 6 is a front view in a state where the opening and closing cover is opened in FIG. 2.

FIG. 2 is a partially-cut front view of the transfer device shown in FIG. 1. FIG. 3 is a diagram which illustrates the positioning member shown in FIG. 2. FIG. 4 is a diagram which illustrates the roller hook shown in FIG. 2. FIG. 5 is a diagram which illustrates the main body of the image forming apparatus when the opening and closing cover shown in FIG. 2 is opened. FIG. 6 is a front view of the opening and closing cover shown in FIG. 2, which is opened.

As shown in FIGS. 2 and 5, in the one transfer roller 11 of the transfer device 10, a roller axis portion 11*b* protrudes from each of both ends of the roller main body 11*a* in an axial direction toward the outside in the axial direction, and these roller axis portions 11*b* are rotatably and pivotally supported by the main body 2 of the image forming apparatus. The positioning member 30 which performs the positioning of the other transfer roller 12 is fixed to both sides of the roller main body 11*a* in the axial direction, respectively in the main body 2 of the image forming apparatus. As shown in FIG. 3, in the positioning member 30, an engaging portion 32 which extends in a horizontal direction from a flat plate-shaped main body 31, protrudes to the outside of the main body 2 of the apparatus, through the opening portion 2*a* of the main body 2 of the apparatus. The engaging portion 32 has a fitting recess 33 whose front end is open. The fitting recess 33 is formed to be surrounded by an upper arm portion 34 and a lower arm portion 35 which vertically face each other, and extends vertically and horizontally, and a deep end surface 36 which extends in a perpendicular direction.

Both roller axis portions 11*b* of the one side transfer roller 11 are attached with, for example, an antifriction bearing 37, and a roller hook 38 is mounted in the antifriction bearing 37. As shown in FIG. 4, in the roller hook 38 with a shape of a flat L lever, a hole portion 39 which fits to an outer periphery portion of the antifriction bearing 37 is formed in the center portion. A hook portion 41 is formed in a front end portion of a first lever portion 40 of the roller hook 38, and a spring hole 45 to which a pressurizing spring 44 for applying the nip load to a second lever portion 42 is attached, is formed. One end of the pressurizing spring 44 is attached to the main body 2 of the image forming apparatus, and the other end is attached to the spring hole 45, and rotates the roller hook 38 clockwise when a spring force is applied in a direction of an arrow c.

In the hook portion 41 of the roller hook 38, a locking end surface 43 is positioned in front of the fitting recess 33, and an engaging space 46 for engaging is formed between the hook portion 41 and a front end of the lower arm portion 35.

In the other transfer roller 12, a roller axis portion 12*b* protrudes from each of both ends of the roller main body 12*a* in an axial direction to the outside in the axial direction. For example, an antifriction bearing 50 is mounted on each of both roller axis portions 12*b*, and a front end portion of each roller axis portion 12*b* is rotatably and pivotally supported by an axis hole portion 3*b* which is formed on a side wall portion 3*a* of the opening and closing cover 3. The antifriction bearing 50 engages with the fitting recess 33 in a vertical direction without backlash.

An internal diameter of the axis hole portion 3*b* is formed to be larger than an external diameter of the roller axis portion 12*b*, and the roller axis portion 12*b* is able to move in the axis hole portion 3*b* in a radial direction. Accordingly, the other transfer roller 12 is able to move in a plane which is perpendicular to the other transfer roller in an axial direction, with respect to the opening and closing cover 3.

On the main body 2 side of the image forming apparatus, a cover lock axis 2*b* facing the opening portion 2 is attached facing the main body 2 of the image forming apparatus in a front and rear direction, to an upper position of the opening 2*a*. In addition, a bearing member 2*c* for the opening and closing cover facing the opening portion 2*a* is attached facing the main body 2 of the image forming apparatus in the front and rear direction, to a lower position of the opening 2. An opening and closing axis 3*c* which is pivotally supported by each bearing member 2*c*, is attached to the lower portion of the opening and closing cover 3, and the opening and closing cover 3 is opened and closed using the opening and closing axis 3*c* as a fulcrum.

A hook 48 for the cover lock which is urged in a direction of an arrow d using a locking spring 47, is provided to correspond to a cover lock axis 2*b* in the opening and closing cover 3. Further, if the opening and closing cover 3 is closed, the hook 48 for the cover lock engages with the cover lock axis 2*b*, and the opening and closing cover 3 is locked at a closing position.

When the opening and closing cover 3 rotates around the opening and closing axis 3*c* which is the fulcrum, the engaging space 46 for the engaging is positioned in a moving trace of the antifriction bearing 50 which is provided in the other transfer roller 12.

Accordingly, when the opening and closing cover 3 is rotated to the closing position, the antifriction bearing 50 rotates the roller hook 38 counterclockwise against the spring force of the pressurizing spring 44, in order to widen the engaging space 46. Further, if the antifriction bearing 50 is pushed into the fitting recess 33, the roller hook 38 rotates clockwise due to the spring force of the pressurizing spring 44, and the locking end surface 43 of the hook portion 41 pushes the antifriction bearing 50 toward the deep end surface 36.

The distance between axes of the one transfer roller 11 and the other transfer roller 12 is set to a predetermined distance under the optimal transfer conditions, at a position where the antifriction bearing 50 of the other transfer roller 12 comes into close contact with the deep end surface 36 of the positioning member 30. In addition, the spring force of the pressurizing spring 44 is applied to the other transfer roller 12 through the roller hook 38 which is attached to the main body 2 side of the image forming apparatus. Accordingly, it is possible to pressurize the other transfer roller 12 with respect to the one transfer roller 11, with a predetermined nip load.

In addition, the locking end surface 43 is perpendicular to a horizontal axis line L which connects center axes of both transfer rollers 11 and 12, in a state which is shown in FIG. 2, where the roller hook 38 locks the antifriction bearing 50 of the other transfer roller 12, and the predetermined distance between axes which is determined under the optimal transfer conditions, is set with respect to the one transfer roller 11. In addition, the center axis of the other transfer roller 12 and the center of the opening and closing axis 3*c* are deviated by a distance L1.

The spring force of the pressurizing spring 44 which is applied to the other transfer roller 12 is not applied to the opening and closing cover 3. Therefore, the strength or the like, of the opening and closing cover 3 may be set without considering the nip load which is applied to the one transfer roller 11 by the other transfer roller 12.

In the embodiment of the invention, as shown in FIG. 5, the spring force of the pressurizing spring 44 is applied to the one transfer roller 11 using the roller hook 38, in a state where the roller hook 38 is disposed between the positioning member 30 and the roller main body 11*a*, and both roller axis portions 12*b* of the other transfer roller 12 are supported by the positioning member 30. In this case, the other transfer roller 12 is bent toward the one transfer roller 11, using both the positioning members 30 as a fulcrum. For this reason, it is possible for the roller main body 12*a* of the other transfer roller 12 to apply a substantially uniform nip load along the axial direction to the roller main body 11*a* of the one transfer roller 11.

In addition, if the opening and closing cover 3 is opened, the roller hook 30 rotates counterclockwise, the locking end surface 43 is retreated from the front of the fitting recess 33 of the positioning member 30 to widen the locking space 46, and the locking of the antifriction bearing 50 of the other transfer roller 12 is released.

Second Embodiment

Figure 7:
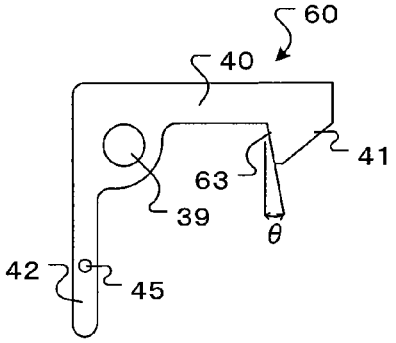
FIG. 7 is a diagram which illustrates a roller hook according to a second embodiment.
Figure 8:
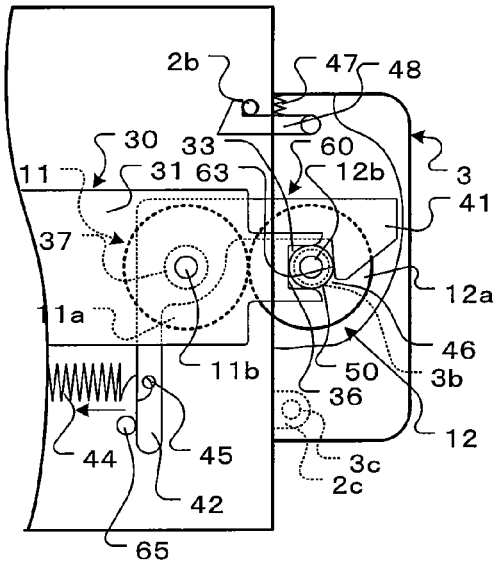
FIG. 8 is a diagram which illustrates a transfer device according to the second embodiment, and a state where the opening and closing cover is closed.
Figure 9:
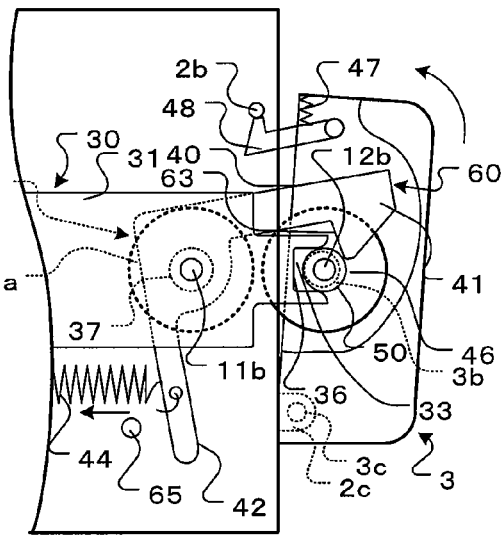
FIG. 9 is a diagram which illustrates a state where the opening and closing cover is about to close in FIG. 8.

FIG. 7 illustrates a roller hook according to a second embodiment, and FIG. 8 illustrates a transfer device where an opening and closing cover is closed, according to the second embodiment of the invention. FIG. 9 is a diagram which illustrates a state where the opening and closing cover is about to be closed in FIG. 8.

Differences between a roller hook 60 shown in FIG. 7 and the roller hook 38 shown in FIG. 4 are that a locking end surface 63 of a hook portion 41 is formed to be an inclined surface with an angle θ, and a length of a second lever portion 42 which is sufficient to come into contact with a stopper axis 65, is provided to a front end side of a spring hole 45.

In the embodiment, in a state shown in FIG. 8 where the roller hook 60 is locked to an antifriction bearing 50 of the other transfer roller 12, and a predetermined distance between axes is set with respect to the one transfer roller 11, the locking end surface 63 is formed to be an inclined surface with the angle θ, with respect to a horizontal axis line L which connects the center axes of both transfer rollers 11 and 12.

With such a configuration, as shown in FIG. 9, the antifriction bearing 50 which is provided in the other transfer roller 12 comes into contact with the locking end surface 63 immediately before an opening and closing cover 3 is completely closed. In addition, when the opening and closing cover 3 is further pushed in a closing direction, the roller hook 60 rotates clockwise due to a spring force of a pressurizing spring 44, the antifriction bearing 50 is pushed toward the deep end surface 36 of the fitting recess 33 using a wedge effect of the locking end surface 63, and the roller hook 60 stops rotating at a stop position where a second lever portion 42 which is a stopper shown in FIG. 8, comes into close contact with a stopper axis 65.

At this stop position, the one transfer roller 11 and the other transfer roller 12 are maintained at a predetermined distance between axes which is determined under the optimal transfer conditions, similarly to the first embodiment, and a predetermined nip load is generated.

In the embodiment, the force of the roller hook 60 which pulls the other transfer roller 12 to the one transfer roller 11 is generated due to the wedge effect of the locking end surface 63, using a spring force of the pressurizing spring 44. For this reason, a return force of the pressurizing spring 44 is added to the opening and closing cover 3, accordingly, it is possible to smoothly close the opening and closing cover 3, and the opening and closing cover 3 is elastically maintained at a closing position, using the spring force of the pressurizing spring 44. In addition, it is possible to set a pressing force of the opening and closing cover 3 to a level that can be easily operated when closing the opening and closing cover 3, by changing the spring force of the pressurizing spring 44 and an inclined angle of the locking end surface 63.

Third Embodiment

Figure 10:
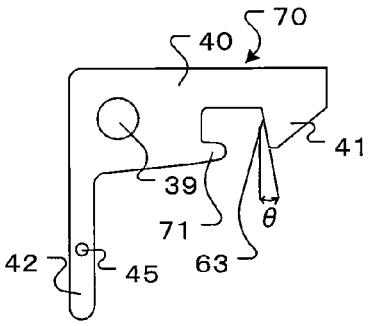
FIG. 10 is a diagram which illustrates the roller hook according to a third embodiment.
Figure 11:
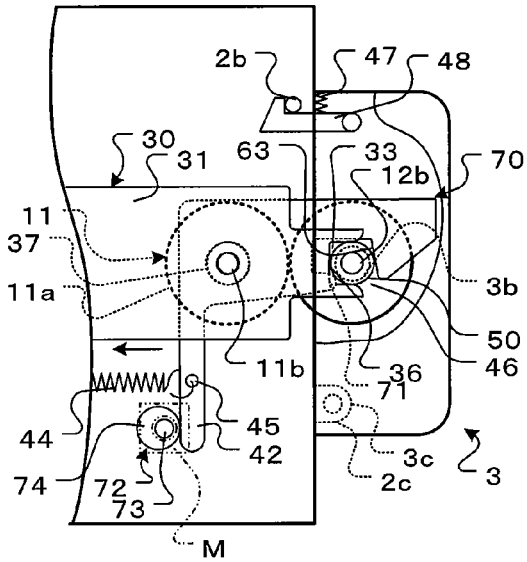
FIG. 11 is a diagram which illustrates a transfer device according to the third embodiment, and a state where the highest nip load is adjusted.
Figure 12:
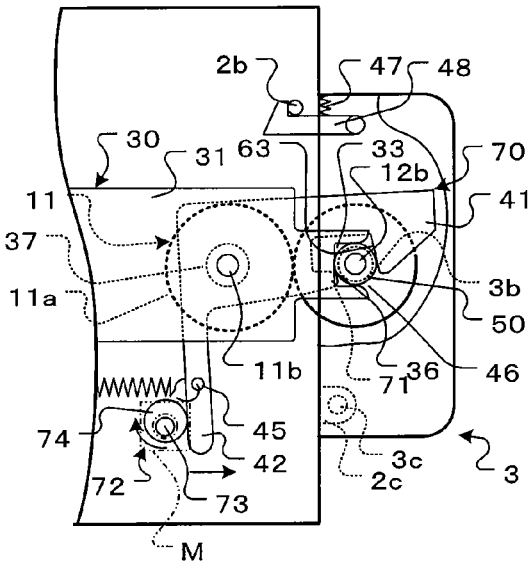
FIG. 12 is a diagram which illustrates the transfer device according to the third embodiment, and an adjusting state where the nip load is weaker than that in FIG. 11.
Figure 13:
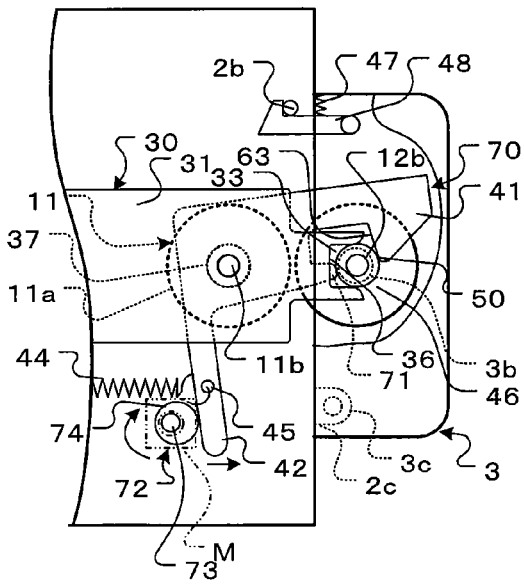
FIG. 13 is a diagram which illustrates the transfer device according to the third embodiment, and a state where the nip load is not applied.

FIG. 10 illustrates a roller hook according to a third embodiment. In the third embodiment, it has a structure in which a distance between axes of the one transfer roller 11 and the other transfer roller 12 is changed, and the nip load is adjusted, in a state where an opening and closing cover 3 is closed. In FIG. 11, the distance between axes of the pair of transfer rollers 11 and 12 is short. In FIG. 12, the distance between axes of the pair of transfer rollers 11 and 12 is medium. In FIG. 13, the distance between axes of the pair of transfer rollers 11 and 12 is widened to be a non-contact state.

Differences between a roller hook 60 shown in FIG. 7 and the roller hook 70 shown in FIG. 10 are that a push back protrusion (a contact portion) 71 which comes into close contact with an antifriction bearing 50 provided in the other transfer roller 12, is provided, facing a locking end surface 63 of a hook portion 41, and an eccentric cam 72 is rotatably provided, instead of the stopper axis 65 shown in FIGS. 8 and 9.

The eccentric cam 72 has a configuration in which a cam plate 74 is fixed to a cam axis 73, by deviating an axis center of the cam axis 73 which is rotatably and pivotally supported by the main body 2 of the image forming apparatus and an axis center of the disc-shaped cam plate 74, and a second lever portion 42 comes into contact with the outer peripheral surface of the cam plate 74. If an offset amount at a cam position shown in FIG. 11 is 0, the offset amount in the eccentric cam 72 increases as the cam axis 73 rotates clockwise. FIG. 12 shows a case where the rotation angle of the cam axis 73 is 90 degrees, and FIG. 13 shows a case where the rotation angle of the cam axis 73 is 180 degrees. The offset amount of the eccentric cam 72 shown in FIG. 13 is the maximum.

The eccentric cams 72 which are respectively provided to both ends of the one transfer roller 11 in an axial direction, may rotatably drive the cam axis 73, individually, for example, using a motor 75.

If the eccentric cam 72 is adjusted to a reference position which is shown in FIG. 11 where the offset amount is 0, the antifriction bearing 50 which is provided to the other transfer roller 12 is set to a distance between axes which is determined under the optimal transfer conditions in which the antifriction bearing 50 comes into close contact with the deep end surface 63 of the fitting recess 33 of the positioning member 30. In addition, in a state where the distance between axes is set, irrespective of whether the push back protrusion of the roller hook 70 comes into contact with the antifriction bearing 50, or not, a force is not applied in a direction of push back.

Accordingly, the counterclockwise rotation of the roller hook 70 is suppressed using the eccentric cam 72 as the stopper, the pair of transfer rollers 11 and 12 are set to the distance between axes which is determined under the optimal transfer conditions, and the optimal nip load is applied.

When the eccentric cam 72 rotates clockwise, the roller hook 70 rotates counterclockwise against to the spring force of the pressurizing spring 44, and the antifriction bearings 50 which are respectively provided to both ends of the other transfer roller 12 in an axial direction come into close contact with the push back protrusion 71, and are pushed back toward the locking end surface 63. For this reason, the distance between axes of the pair of transfer rollers 11 and 12, is adjusted. It is possible to separately adjust the distance between axes in the front and rear direction, by allowing the eccentric cams 72 which are disposed at both ends of the one transfer roller 11 in an axial direction (the front and rear direction), to be eccentric, respectively.

The nip load between the transfer rollers in the front and rear direction becomes uneven, when the distance between axes of the other transfer roller 12 in the front and rear direction is different, due to a variation in precision of a size of the positioning member 30 which is provided on the main body 2 side of the image forming apparatus, or a precision of attachment. There is a problem that the uneven nip load between the transfer rollers causes deterioration of images.

However, according to the embodiment, it is possible to adjust the distance between axes of the pair of transfer rollers 11 and 12 in the front and rear direction, to be equal, by separately adjusting the eccentric cams 72 which are respectively disposed at the front and rear of one transfer roller 11.

In addition, as shown in FIG. 13, when opening the opening and closing cover 3, the roller hook 70 largely rotates counterclockwise, so as to widen a space 46 in advance. If the opening and closing cover 3 rotates in an opening direction in this state, the antifriction bearing 50 allows the roller hook 70 to slightly rotate counterclockwise, to further widen the space 46. For this reason, the antifriction bearing 50 is extracted from the space 46, thereby opening the opening and closing cover 3.

Subsequently, when the opening and closing cover 3 is closed while maintaining the roller hook 70 at a state shown in FIG. 13, the antifriction bearing 50 engages with the roller hook 70 with almost no load, and comes into close contact with the push back protrusion 71. In addition, the nip load is set to the optimal transfer conditions, by rotating the eccentric cams 72 which are disposed at the front and rear of the one transfer roller 11, respectively, to a position which is shown in FIG. 11, due to a driving by a motor M, or a position shown in FIG. 12 where the distance between axes in the front and rear is separately adjusted. For this reason, a reaction force of the nip load is not applied to the opening and closing cover 3, when closing the opening and closing cover 3.

Fourth Embodiment

Figure 14:
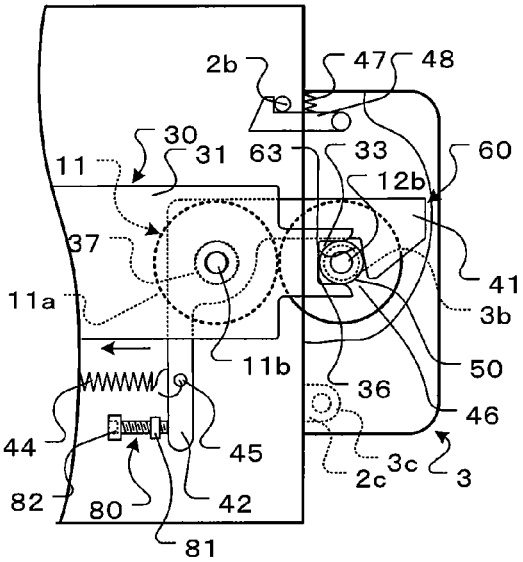
FIG. 14 is a diagram which illustrates a transfer device according to a fourth embodiment, and an adjusting state of a stop position of the transfer roller.
Figure 15:
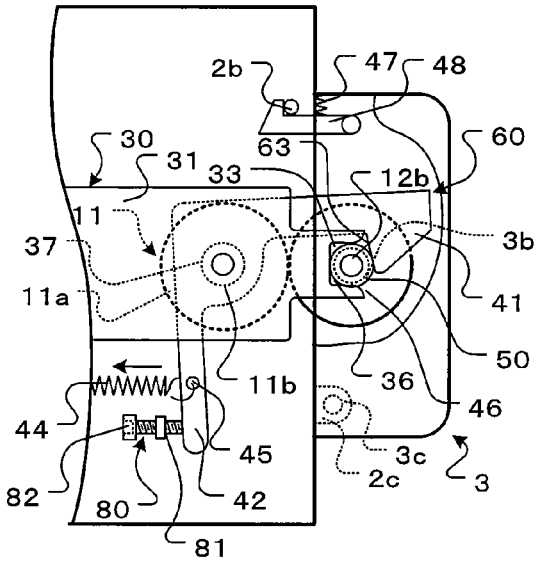
FIG. 15 is a diagram which illustrates the transfer device according to the fourth embodiment, and a state where the stop position of the transfer roller is adjusted to a position different from the position in FIG. 14.

FIGS. 14 and 15 illustrate a transfer device according to a fourth embodiment. In the embodiment, a modified example of the second embodiment shown in FIGS. 7 to 9 is illustrated, and in the embodiment, a stop position of a roller hook 60 can be adjusted.

In the embodiment, a difference from the second embodiment shown in FIGS. 7 to 9 is that it is possible to adjust a stop position of the roller hook 60 using a screw-type adjusting portion 80, instead of the stopper axis 65. The screw-type adjusting portion 80 is formed of a nut member 81 which is fixed to a main body 2 of the image forming apparatus, and an adjusting screw 82 which is screw-fitted to the nut member 81 and whose front end comes into contact with a second lever portion 42 of the roller hook 60.

When the adjusting screw 82 shown in FIG. 14 is rotated to the right, as shown in FIG. 15, the adjusting screw 82 moves toward the second lever portion 42, and the contact position with the second lever portion 42 of the roller hook 60, is changed. In this manner, it is possible to adjust the distance between axes of the pair of transfer rollers 11 and 12 to the optimal transfer conditions by rotating the adjusting screw 82 to the right or to the left, and by adjusting a front end position of the adjusting screw 82 which is the stopper end. Further, it is possible to adjust a variation of the nip load in the axial direction of the pair of transfer rollers 11 and 12, by separately adjusting screw-type adjusting portions 80 which are provided to the one transfer roller 11 in a front and rear direction.

Fifth Embodiment

Figure 16:
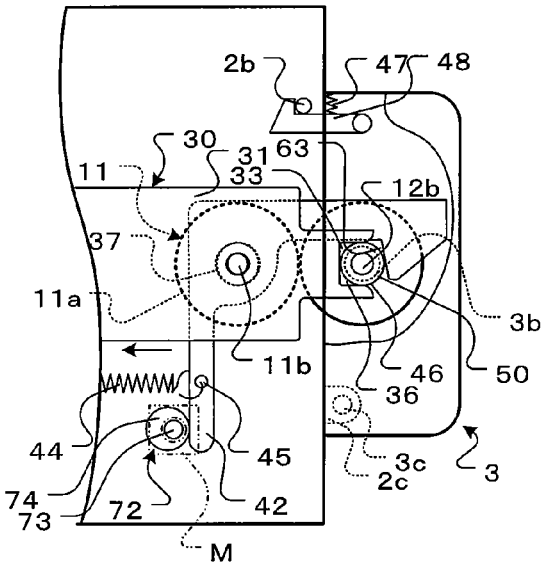
FIG. 16 is a diagram which illustrates a transfer device according to a fifth embodiment, and an adjusting state of a stop position of the transfer roller.
Figure 17:
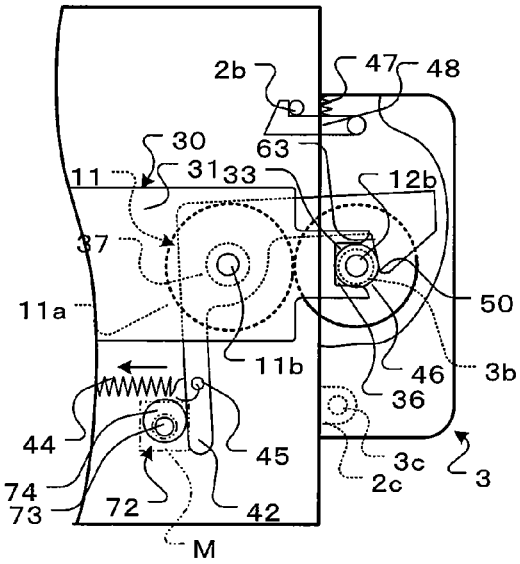
FIG. 17 is a diagram which illustrates a transfer device according to the fifth embodiment, and a state where the stop position of the transfer roller is adjusted to a position different from the position in FIG. 16.

FIGS. 16 and 17 illustrate a transfer device according to a fifth embodiment. In the embodiment, a modified example of the second embodiment shown in FIGS. 7 to 9 is illustrated, similarly to the fourth embodiment. Further, it is possible to adjust a stop position of a roller hook 60.

In the embodiment, a difference from the second embodiment shown in FIGS. 7 to 9, is that it is possible to adjust the stop position of the roller hook 60 using the eccentric cam 72 according to the third embodiment which is shown in FIGS. 11 to 13, instead of the stopper axis 65.

If the eccentric cam 72 is rotated from a position shown in FIG. 16 where the offset amount is 0, by driving a cam axis 73 using a motor, the offset amount increases, and a position where a second lever portion 42 of the roller hook 60 comes into close contact with a cam plate 74 is changed. In this case, it is also possible to adjust a distance between axes of a pair of transfer rollers 11 and 12 to the optimal transfer conditions, similarly to the above-described fourth embodiment. Further, it is possible to adjust a variation of a nip load of the pair of transfer rollers 11 and 12, in an axial direction, by separately adjusting screw-type adjusting portions 80 provided in the one transfer roller 11, in the front and rear direction.

Sixth Embodiment

Figure 18:
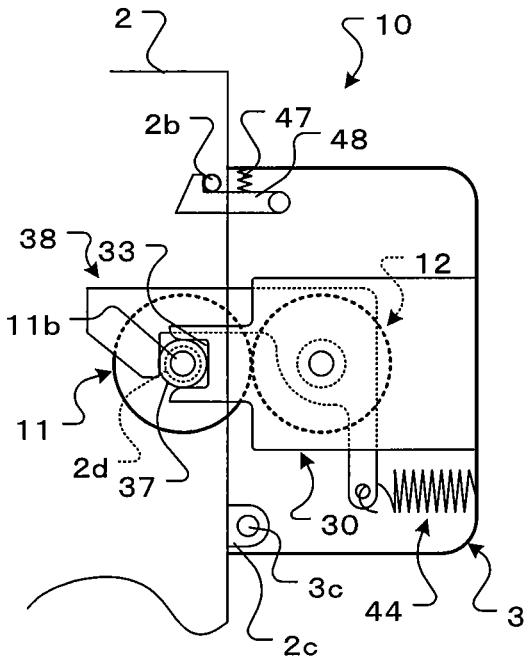
FIG. 18 is a diagram which illustrates a transfer device according to a sixth embodiment.

FIG. 18 illustrates a sixth embodiment. In the embodiment, in contrast to the first embodiment shown in FIG. 2, a roller hook 38, a positioning member 30, and a pressurizing spring 44 are disposed on an opening and closing cover 3. In addition, an antifriction bearing 37 which is provided in the one transfer roller 11 which is disposed on a main body 2 side of the image forming apparatus, is fitted to a fitting recess 33 of a positioning member 30. The roller hook 38 engages with the antifriction bearing 37, and draws in the antifriction bearing 37 towards the other transfer roller 12 to have the predetermined distance of axes. In this case, a roller axis 11*b* of the one transfer roller 11 is shaft supported by a shaft hole 2*d* which is provided on the main body 2 side of the image forming apparatus. The inner diameter of the shaft hole 2*d* is larger than the outer diameter of the roller axis 11*b*, and the one transfer roller 11 can move freely around the shaft.

In the embodiment, in contrast to the first embodiment, the positioning member 30 and the roller hook 38 are disposed on the opening and closing cover 3 side; however, this reverse configuration may be similarly applied to the above-described second embodiment to the fifth embodiment.

In addition, in each embodiment described above, an example was described in which the opening and closing cover 3 rotated around the opening and closing axis 3 as the fulcrum; however, the cover may be a translation-type opening and closing cover.

While certain embodiments have been described, these embodiments have been presented by way of example only, and are not intended to limit the scope of invention. Indeed, the novel apparatus, methods and system described herein may be embodied in a variety of other forms; furthermore, various omissions, substitutions and changes in the form of the apparatus, methods and system described herein may be made without departing from the spirit of the inventions. The accompanying claims and their equivalents are intended to cover such forms or modifications as would fall within the scope and spirit of the inventions.

What is claimed is:

1. A transfer device comprising:

a transfer unit which transfers a toner image to a recording medium which passes through a nip portion formed by a rotary member and a transfer member;

a transfer member holding cover which holds the transfer member, opens and closes by rotation, and moves the transfer member between a closed first position in which the nip portion is formed with respect to the rotary member and an open second position in which the transfer member is separated from the rotary member;

a positioning member which positions the transfer member relative to the rotary member; and an engaging member which contacts one of the transfer member and the rotary member and pushes the one of the transfer member and the rotary member using an elastic force of a pressurizing spring, toward the other one of the transfer member and the rotary member when the transfer member holding cover is in the first position, and does not contact and does not push the transfer member or the rotary member when the transfer member holding cover is in the second position.

2. The device according to claim 1, wherein the one of the transfer and rotary member which is contacted by the engaging member includes a shaft portion protruding from both end portions thereof in a longitudinal direction, the shaft portion being configured to be in contact with the engaging member when the transfer member holding cover is in the first position.

3. The device according to claim 2, further comprising, a bearing member disposed on the shaft portion in a fitting portion in which the positioning member and engaging member are overlapped with each other.

4. The device according to claim 2, wherein the engaging member includes a hook portion having an angled surface which contacts the bearing member at a position where the transfer member holding cover is about to reach the first position.

5. The device according to claim 1, further comprising a stopper member which regulates movement of the engaging member which moves due to the elastic force of the pressurizing spring, and can be set to change a contact the first position of the engaging member.

6. The device according to claim 5, wherein the stopper member is an eccentric cam.

7. The device according to claim 1, wherein the rotary member is disposed on a main body of an apparatus and the transfer member is disposed on the transfer member holding cover.

8. The device according to claim 1, wherein the transfer member is a transfer roller.

9. An image forming apparatus comprising:

an image forming unit which forms a toner image;

a transfer unit which transfers the toner image to a recording medium which passes through a nip portion formed by a rotary member which is disposed on a main body of the image forming apparatus and a transfer member which is disposed on an opening and closing cover which opens and closes an opening of the main body;

a transfer member holding unit which holds the transfer member, and moves the transfer member by rotating between a first position in which the nip portion is formed with respect to the rotary member and a second position in which the transfer member is separated from the rotary member;

a positioning member which positions the transfer member which moves along with a closing operation of the opening and closing cover, to a predetermined distance with respect to the rotary member; and an engaging member which contacts with one of the transfer member and the rotary member, and pushes the one of the transfer member and the rotary member using an elastic force of an elastic member, toward the other one of the transfer member and the rotary member when the transfer member holding unit is in the first position, and does not contact and does not push the transfer member or the rotary member when the transfer member holding unit is in the second position.

10. The device according to claim 9, wherein the one of the transfer and rotary member which is contacted by the engaging member includes a shaft portion protruding from both end portions thereof in a longitudinal direction, the shaft portion being configured to be in contact with the engaging member when the transfer member holding unit is in the first position.

11. The device according to claim 9, further comprising, a bearing member disposed on the shaft portion in a fitting portion in which the positioning member and engaging member are overlapped with each other.

* * * * *

UNITED STATES PATENT AND TRADEMARK OFFICE

CERTIFICATE OF CORRECTION

PATENT NO. : 8,849,158 B2
APPLICATION NO. : 13/247935
DATED : September 30, 2014
INVENTOR(S) : Tadao Kamano It is certified that error appears in the above-identified patent and that said Letters Patent is hereby corrected as shown below:

In the Claim:

Column 10, Claim 5, Line 61, please delete "the first".

Signed and Sealed this
Seventeenth Day of February, 2015

Michelle K. Lee

Michelle K. Lee
*Deputy Director of the United States Patent and Trademark Office*